United States Patent [19]

Ronai

[11] 4,425,741

[45] Jan. 17, 1984

[54] COLLAPSIBLE STRUCTURE

[76] Inventor: Anne A. Ronai, Apartado: 68439, Caracas 106, Venezuela

[21] Appl. No.: 213,487

[22] Filed: Dec. 5, 1980

Related U.S. Application Data

[63] Continuation of Ser. No. 969,414, Dec. 14, 1978, abandoned, which is a continuation-in-part of Ser. No. 810,567, Jun. 27, 1977, abandoned, which is a continuation-in-part of Ser. No. 727,553, Sep. 28, 1976, Pat. No. 4,037,965, which is a continuation of Ser. No. 539,763, Jan. 9, 1975, abandoned.

[51] Int. Cl.[3] ..... E04B 1/346

[52] U.S. Cl. ..... 52/70; 217/14; 217/46

[58] Field of Search ..... 217/14, 15, 46, 47; 220/6; 52/66, 68, 69, 70, 143, 79.8; 296/23, 23 D, 23 G; 108/78, 112

[56] References Cited

U.S. PATENT DOCUMENTS

| | | | |
|---|---|---|---|
| 600,589 | 3/1898 | Moll | 217/46 |
| 721,296 | 2/1903 | Gray | 217/14 |
| 898,778 | 9/1908 | Phelan . | |
| 1,126,088 | 1/1915 | Rosko | 217/14 |
| 1,201,216 | 10/1916 | Minoprio | 217/14 |
| 1,279,620 | 9/1918 | Washington . | |
| 2,155,878 | 4/1939 | Stout | 296/23 G |
| 2,167,557 | 12/1936 | Stout . | |
| 2,363,259 | 11/1944 | Penton | 52/79.8 |
| 2,532,863 | 12/1950 | Taylor | 217/14 |
| 2,765,499 | 10/1956 | Couse . | |
| 2,841,832 | 7/1958 | Couse | 52/79.8 |
| 2,886,856 | 5/1959 | Sak Kun Che . | |
| 3,041,816 | 6/1963 | Wetzel | 52/7 |
| 3,421,268 | 1/1969 | Reynolds | 52/71 |
| 3,521,926 | 7/1970 | Brewin | 296/27 |
| 3,685,220 | 8/1972 | Morrison | 52/71 |
| 3,707,811 | 1/1973 | Hampson | 52/79.8 |
| 3,857,211 | 12/1974 | Sharpton | 52/65 |
| 4,034,524 | 7/1977 | Fromme | 52/143 |

FOREIGN PATENT DOCUMENTS

| | | | |
|---|---|---|---|
| 49122 | 3/1931 | Norway | 220/6 |

*Primary Examiner*—Henry E. Raduazo
*Attorney, Agent, or Firm*—Cushman, Darby & Cushman

[57] ABSTRACT

A structure that is collapsible from a volume-enclosing, expanded position to a position wherein the walls and roof are disposed in a horizontally extending stack of generally vertically disposed members. The roof is pivotally mounted to an upper portion of a free-standing rear wall (which is operatively connected to the ground in free-standing position), and the front wall is pivotally connected to the roof generally along the front edge of the roof. A floor may be provided having at least a portion thereof pivotal with respect to the rear wall so that it can be disposed generally parallel or perpendicular to the rear wall. The side walls may be mounted to the rear wall so that they pivot outwardly with respect to the rear wall, the rear wall being disposed between the side walls and the front wall when the structure is in collapsed position. An interior partition can be provided in the structure, and mechanisms may be utilized for interconnecting two such structures together. Channel guides are formed on the bottom of the floor for receipt of a straight bracing member, and the channel guides may also be utilized for supporting the structure for transport in a collapsed position.

13 Claims, 29 Drawing Figures

Fig. 3
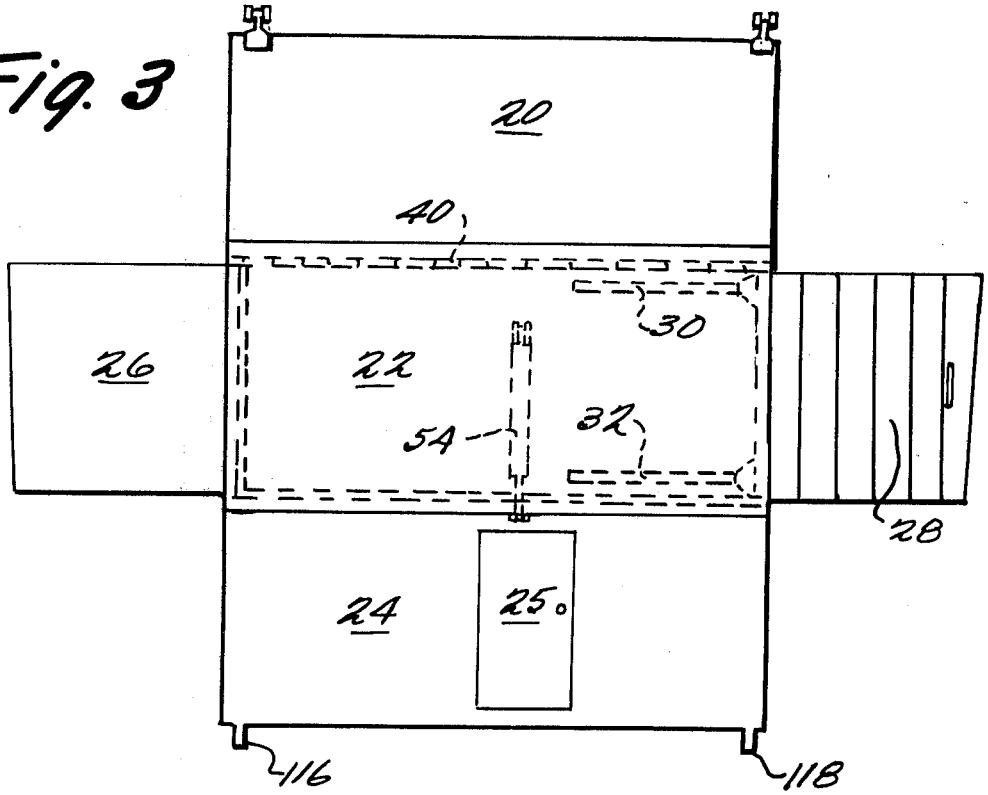
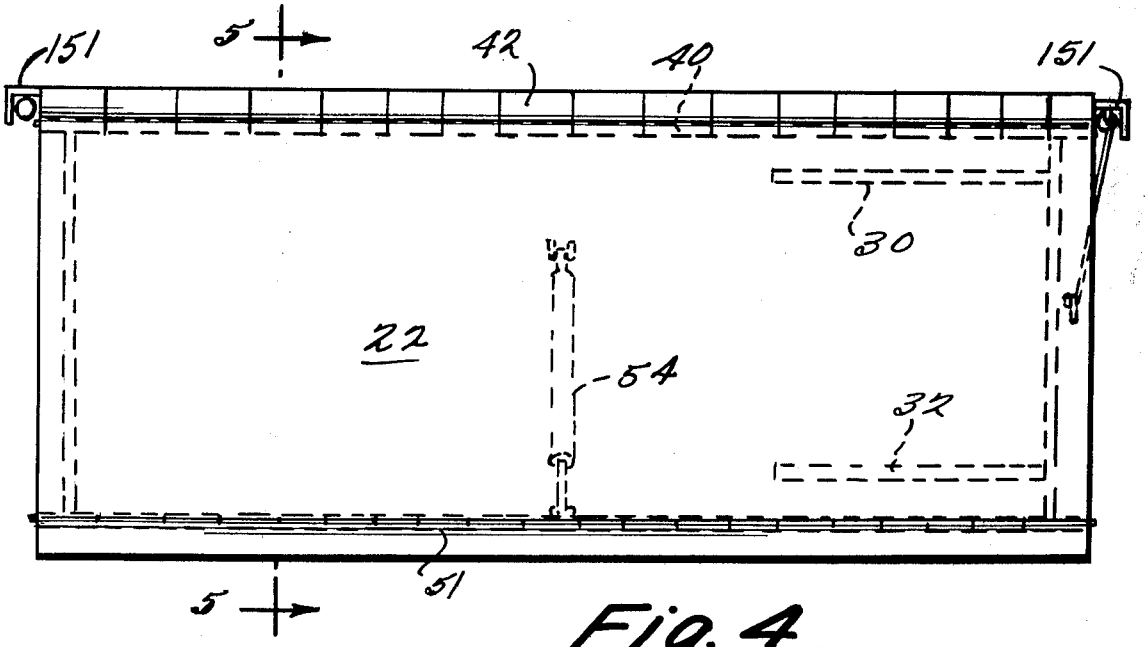
Fig. 4

Fig. 14
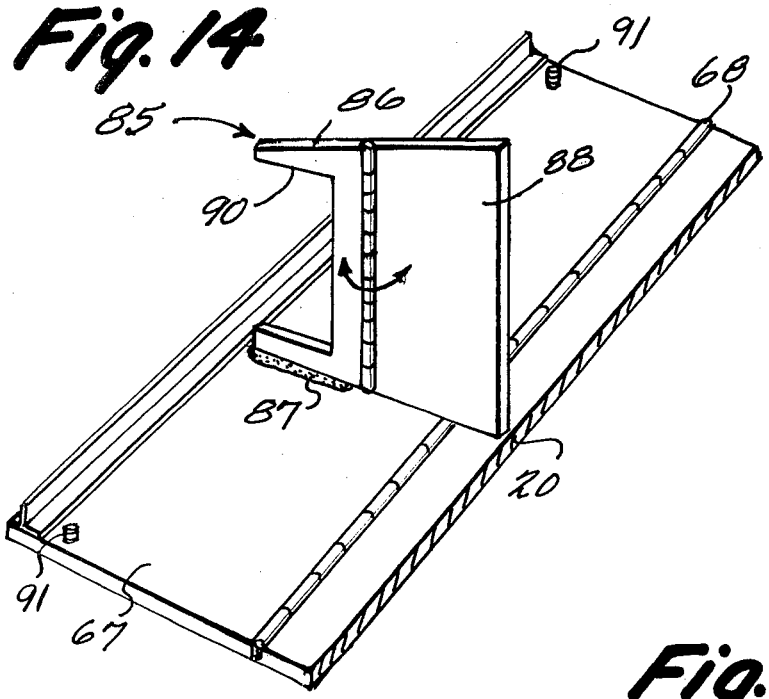
Fig. 15
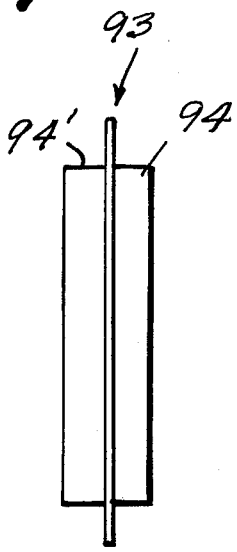
Fig. 16
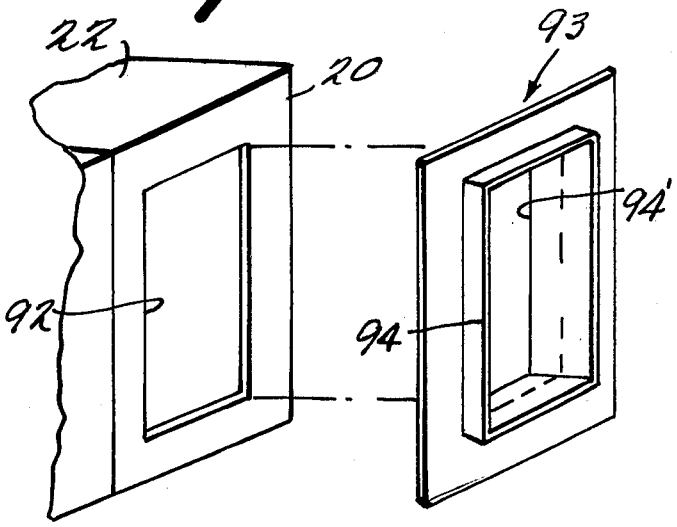
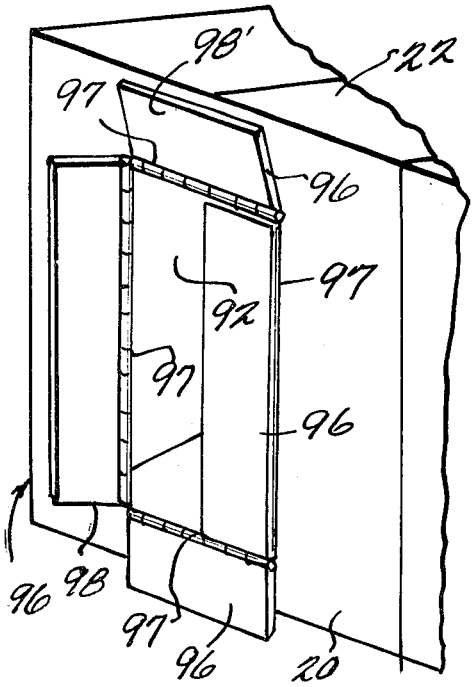
Fig. 17

COLLAPSIBLE STRUCTURE

CROSS-REFERENCE TO RELATED APPLICATIONS

This application is a continuation of application Ser. No. 969,414 filed Dec. 14, 1978 and now abandoned, which in turn is a continuation-in-part of application Ser. No. 810,567 filed June 27, 1977, now abandoned, which in turn is a continuation-in-part of application Ser. No. 727,533 filed Sept. 28, 1976 (now U.S. Pat. No. 4,035,965), which in turn is a continuation of application Ser. No. 539,743 filed Jan. 9, 1975, now abandoned.

BACKGROUND OF THE INVENTION

The invention relates to a structure that is collapsible from a volume-enclosing, expanded position to a position wherein the walls and roof are disposed in a horizontally extending stack of generally vertically disposed members. The structure can be used for any purpose, and can be constructed of any suitable materials (either thick or thin), including sheet steel, aluminum, wood, foam supported by a frame, plastic, and all types of conventional light-weight building materials. The structure may be either stationary or movable with respect to the ground, and in the collapsed position may serve as a fence or like barrier. The structure may be placed on or secured to the ground with or without rails, and may be provided with or without a floor.

According to one aspect of the invention, a collapsible structure is provided including a free-standing rear wall having top and bottom edges extending generally linearly and defining a generally vertical plane, and means operatively connecting said free-standing rear wall to the ground for supporting the rear wall in free-standing position [such as a stationary support or means connecting the wall to rail means]. Also provided is a roof having opposed front and rear edges extending generally parallel to said rear wall front and rear edges, said roof being pivotally connected at its rear edge to an upper portion of said rear wall, and a front wall pivotally connected to said roof generally along the front edge of said roof, and side walls operatively connected to said roof, front wall and rear wall so that said side walls, front wall, and roof extend generally parallel to said rear wall. According to another aspect of the invention, a collapsible structure is provided including a rear wall having top and bottom edges extending generally linearly and defining a generally vertical plane, and a roof having opposed front and rear edges extending generally parallel to said rear wall front and rear edges, said roof being pivotally connected at its rear edge to an upper portion of said rear wall. Also provided is a front wall pivotally connected to said roof generally along the front edge of said roof, and side walls operatively connected to said roof, front wall and rear wall so that said side walls, front wall and roof can be pivoted and folded together into a generally stacked position in which all of said side walls, front wall, and roof extend generally parallel to said rear wall, and a floor, said floor having at least a portion thereof mounted for pivotal movement with respect to said rear wall so that in one position thereof said at least a portion of said floor extends generally perpendicularly to said rear wall, and in another position thereof extends generally parallel to said rear wall, being disposed in said horizontally extending stack.

In one embodiment of the invention of this application as described in detail below, this structure is formed with a rear wall which engages the pair of parallel extending rails for movement along the rails. The rails may include a slot with the rear wall attached to a roller in the slot of each rail for movement therealong. Each of the rail sections preferably is provided with a flap pivotally attached along its side for pivoting to a position covering the slot to protect the slot against dirt or other material being lodged therein and preventing ready movement of the rear wall. The structure may be used with or without rails. The structure may be placed on or secured to the ground (and leveled) with or without the floor.

The roof may be provided with an overhang on at least the front and sides thereof for directing as much rain as possible off of the shed and the shed roof is preferably inclined slightly, sufficiently to shed flap pivotally attached along its side for pivoting to a position covering the slot to protect the slot against dirt or other material being lodged therein and preventing ready movement of the rear wall.

The roof may be provided with an overhang on at least the front and sides thereof for directing as much rain as possible off of the shed and the shed roof is preferably inclined slightly, sufficiently to shed rain and prevent accumulation of water, snow and the like. Means, such as an air cylinder or the like, may be connected between the roof and the front wall for ensuring that the front wall does not pivot downward too quickly during assembly of the unit.

According to other aspects of the present invention, other apparatus is provided for making the structure according to the present invention more flexible and adaptable, and in general more versatile. Partitioning means may be provided which are collapsible with the rest of the structure, and upon assembly may be pivoted into position to divide the interior of the structure, a passageway being provided through the partition. Additionally, connection means may be provided for operatively connecting the structure to a sturcture through openings defined therein, such connection means taking the form of a lipped flange, pivoted tunnel forming members, or the like. Further, the floor of the structure may be locked in position and braced by passing a plurality of straight bracing members through channel guides formed on the bottom of the structure. The channel guides may also be adapted to receive a channel having wheels pivoted thereto, which channel member can be dimensioned to support two collapsed structures in back-to-back position. Additionally, means may be provided for facilitating travel of the structure either in assembled or collapsed position on highways, and means are provided for operatively attaching the front wall to the floor in the assembled position.

It is the primary object of the present invention to provide a versatile collapsible structure. This and other objects of the invention will become clear from an inspection of the detailed description of the invention, and from the appended claims.

BRIEF DESCRIPTION OF THE DRAWINGS

FIG. 3 shows a top spread out view of the structure of FIG. 2;

FIG. 4 shows a top plan view of the structure of FIG. 2;

FIG. 8 shows a part of a further embodiment of the invention assembled as a shed, vehicle garage, or the like;

FIG. 14 is a perspective view, with the rest of the structure cut away, of the floor of a structure according to the present invention showing a collapsible partition and operative association therewith;

FIG. 15 is a side view of a flange for connecting two structures according to the present invention together;

FIG. 16 is a perspective view illustrating the flange of FIG. 15 in prospective relationship with a structure according to the invention;

FIG. 17 is a perspective view of another exemplary connecting means utilizable according to the present invention;

FIGS. 27 and 28 are bottom and side views respectively of exemplary structures according to the present invention mounted for transport along a highway or the like; and FIG. 29 is a front view partly in cross-section and partly in elevation of a structure according to the invention in semi-collapsed position mounted for transportation along a highway or the like.

DETAILED DESCRIPTION OF THE DRAWINGS

Figure 2:
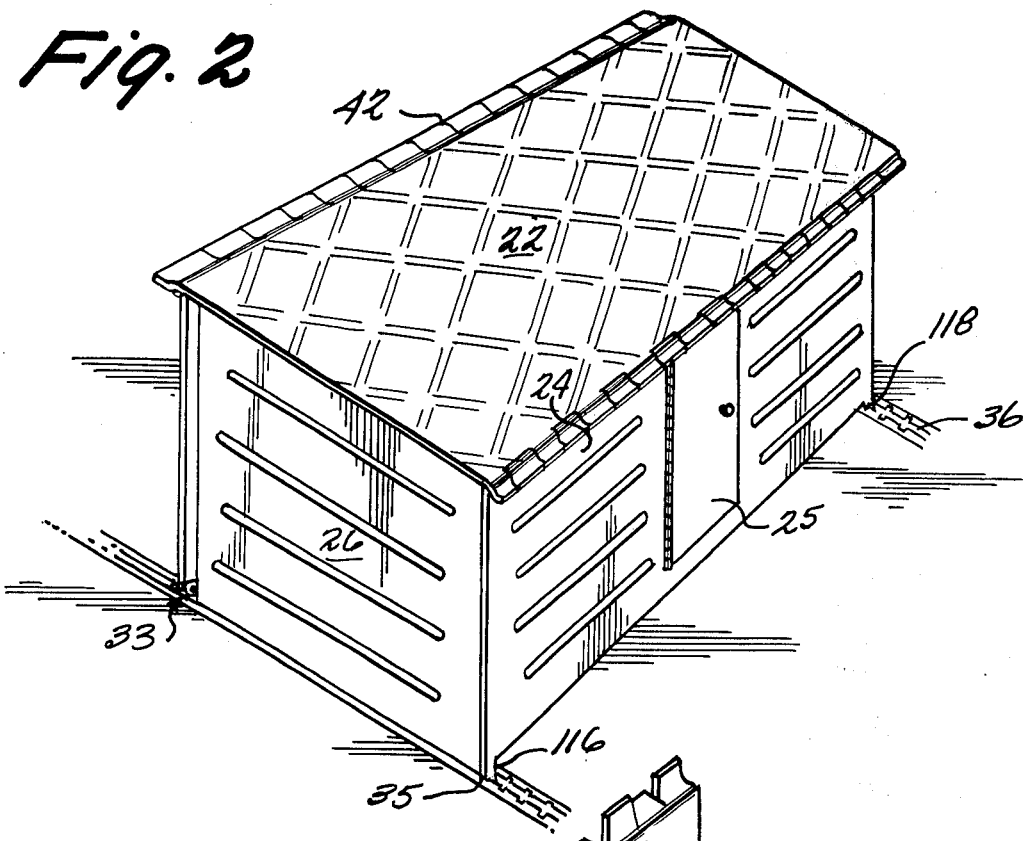
FIG. 2 shows a perspective view of the structure of FIG. 1 assembled in an expanded position.
Figure 1:
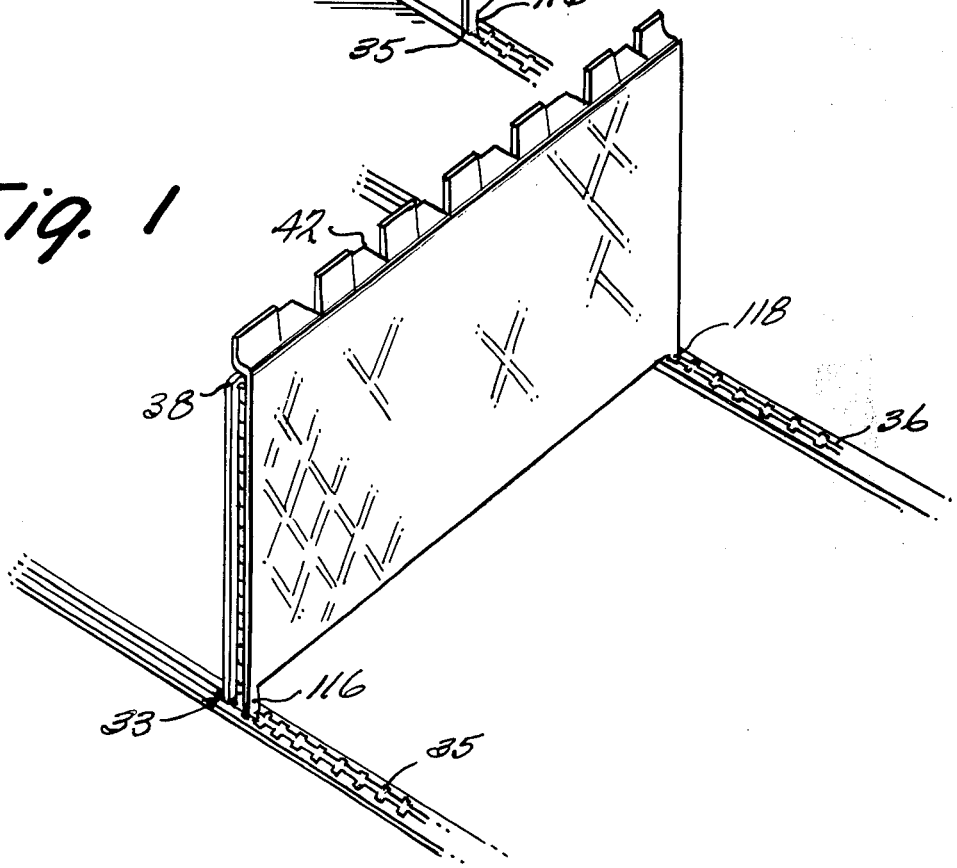
FIG. 1 shows a perspective view of one embodiment of the present structure disposed in a collapsed position.

Reference is now made to FIGS. 1–5 which illustrate one embodiment of the structure of the specification. The structure basically includes a rear wall section 20, a roof section 22 pivotably connected at one edge of rear wall section 20, a front wall 24 pivotably connected to the roof section 22 along the edge opposite the pivotably connection of roof section 22 to the rear wall 20, and side walls 26 and 28. Front wall 24 is provided with a suitably positioned and secured door 25, and a door can be provided in any wall. Side wall 26 is pivotably connected to an edge of roof 22 as illustrated in, for example, FIG. 2. Wall 28 is illustrated in FIG. 1 enclosing the space within the shed to a position extending parallel to roof 20. Side wall 28 slides along rails 30 and 32 provided on the interior surface of roof 22 in conventional fashion to provide an opening for driving a vehicle into the enclosed space.

The walls may be formed of any suitable material such as fiberglass, laminated fiberglass, aluminum, wood, sheet metal, corrugated metal, plastics, plastic composites, or synthetic base also supplied with or without insulation materials, etc. and may be provided with any suitable ornamental finish such as a brick, stone, wood, etc., embossed, pebbled, painted or otherwise formed.

Figure 10:
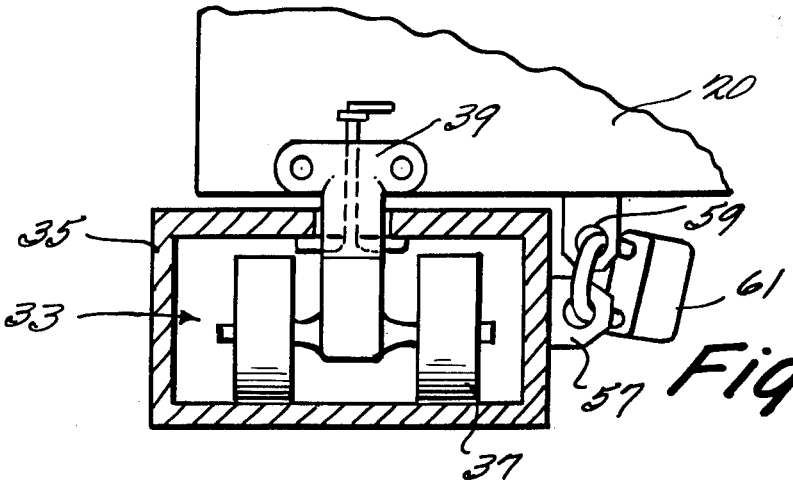
FIG. 10 is an enlarged fragmentary detail through an exemplary rail showing a caster within a rail channel.

Means are provided for mounting rear wall 20 to the ground for supporting the rear wall in free-standing position (without connection to other accessory, supporting, building structures). Such means may include any type of conventional means for stationarily mounting the rear wall 20 to the ground, or means mounting the rear wall 20 so that it is movable with respect to the ground. Such movement-allowing means could include conventional casters 33 and 34 which are movable within rails 34 and 36 for moving the rear wall 30, together with the walls and roof attached thereto, along the direction of the rails to permit the barrier to be placed as described or the shed to be assembled at any desired location. Each caster, as shown in FIG. 10, includes a roller 37 and brake 39. Rails 35 and 36 may be mounted on a platform if desired. Rails 35 and 36 are preferably formed as a plurality of separate sections which can be interconnected as illustrated in FIG. 7 and as described in detail below to form a rail of any given length desired.

Figure 5:
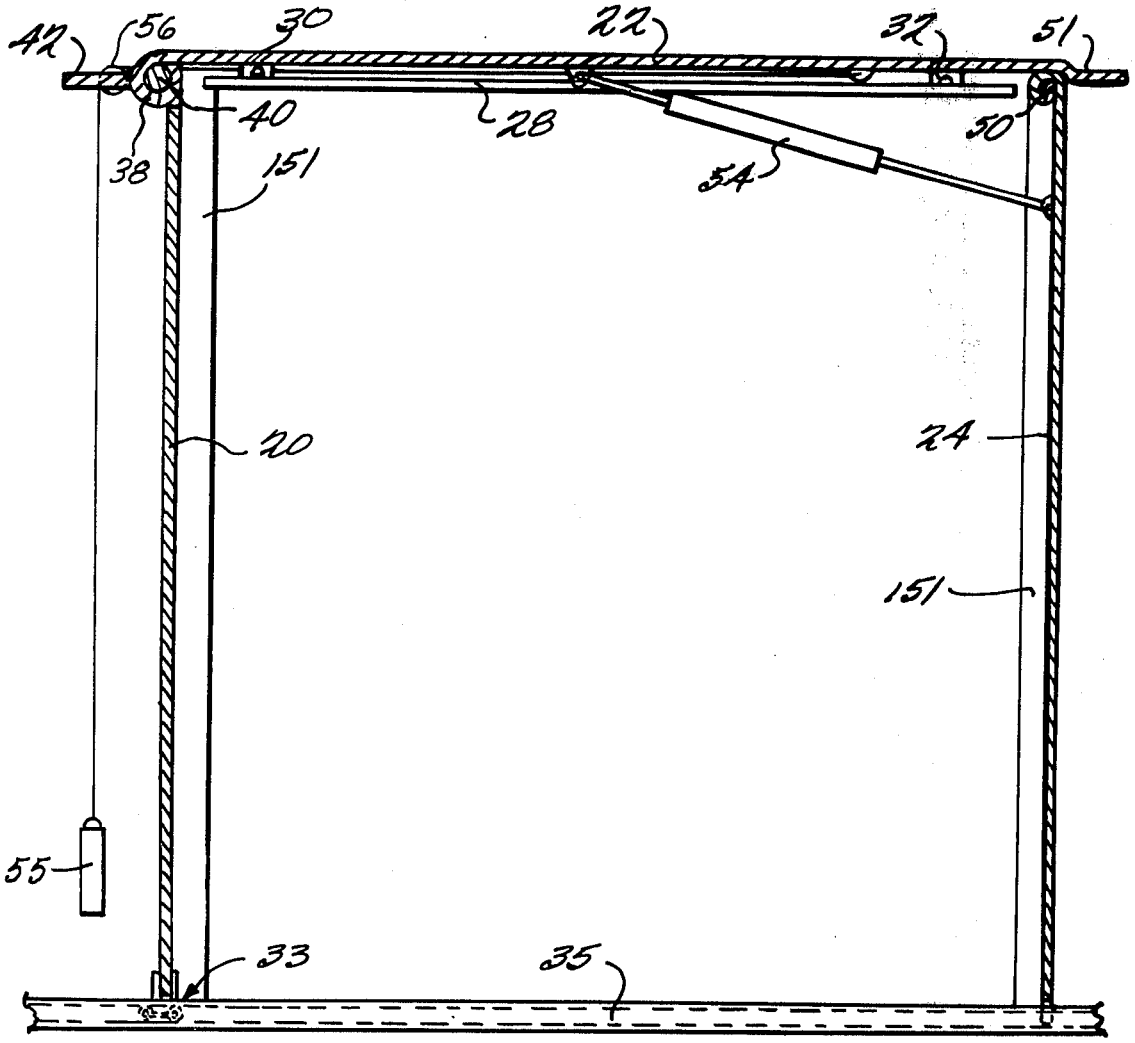
FIG. 5 shows a section view along the lines 5—5 in FIG. 4.

Rear wall 20 forms at its upper edge a hinge 38 as can be seen, for example, in FIG. 5. Alternate sections of rear wall 20 and roof 22 are bent in opposite directions to form a hinge as can be seen in FIG. 4 with pin 40 extending between the bent sections to form a pivotable connection between rear wall 20 and roof 22. The unbent sections of rear wall 20 and roof 22 extend outward to form a ledge 42 which serves to convey rain and the like away from the rear wall and to provide a suitable overhang.

The upper part of the front wall 24 is similarly bent as can be seen in FIG. 5 together with alternate sections of roof 22 to form a hinge which is held in place by pin 50. An overhang 51 is provided. Similarly the upper edge of side wall 26 is alternately bent as illustrated in FIG. 7 as is the adjoining portions of roof 22 to form a hinge which is held in place by a similar pin. Referring to FIGS. 3 and 5, a conventional air cylinder 54 or other similar means is connected between the front wall 24 and the roof 22 to prevent front wall 24 from falling too rapidly and possibly injuring the individual assembling the unit as a shed. Further, a counterweight 55 is connected via pulley 56, attached to rear wall 20, to roof 22 to aid in pulling the roof from a vertical to horizontal position. Any other mechanism such as a rachet can be alternatively employed.

Figure 7:
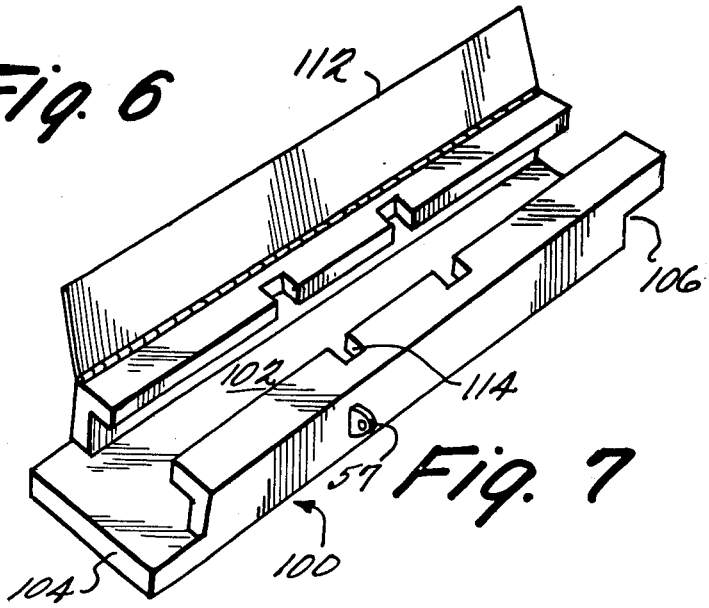
FIG. 7 shows a perspective view of an exemplary rail section.

FIG. 7 illustrates one of the sections which form the rails 35 and 36. Section 100 is formed with a slot 102 extending along its length through which the caster mechanism 33 or 34 extends to conventionally permit the end wall 20 and the walls 24, 26 and 28 as shown in FIG. 10 and roof 22 attached to it to be moved along rails 35 and 36. Section 100 is provided with an eye 57 which can be locked to eye 59 on end wall 20 by lock 61. Section 100 includes male portion 104 which engages a mating female portion 106 at the other end as can be seen in FIG. 10. Thus the sections can be easily and quickly snapped into place. Cover 112 is pivotably attached along one side of a rail section 100 for permitting the rail section to be covered to prevent the slots 102 from being filled with dirt or the like when a rail section is not being used to move an end wall. Transverse slots 114 are preferably provided at intervals on each of the rails for engaging a forked portions 116 and 118 on the lower edges of the front wall 24 as can be seen, for example, in FIG. 3 for locking the shed firmly in place when assembled.

Heat can be supplied to the channels formed by the rail sections to heat the interior space when the structure is assembled as a shed.

Vertical flaps or cornice 151 cover the sides of the structure when folded as a fence.

Figure 8:
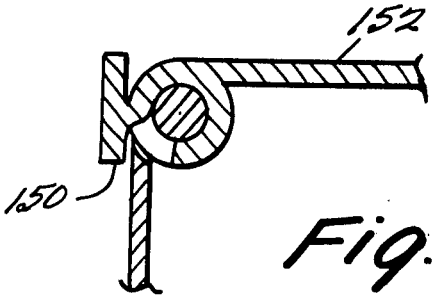
Figure 9:
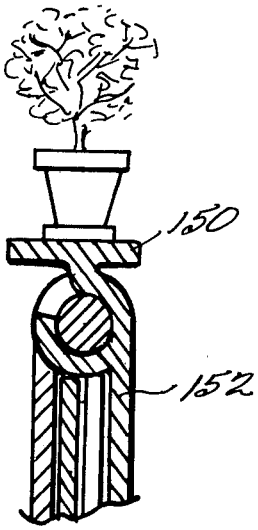
FIG. 9 shows a portion of the further embodiment of the structure of FIG. 1.

FIGS. 8 and 9 illustrate a further embodiment of the structure, which relates to the shape of the overhang 150 of roof section 152. As illustrated in FIGS. 8 and 9, by providing an overhang which extends vertically when the structure is assembled as a shed, the overhang 150 will provide a horizontal surface atop the structure when it is assembled as a fence or barrier which will permit plants or the like to be placed thereon, thus providing greater opportunities for decorative use of the structure.

Figure 11:
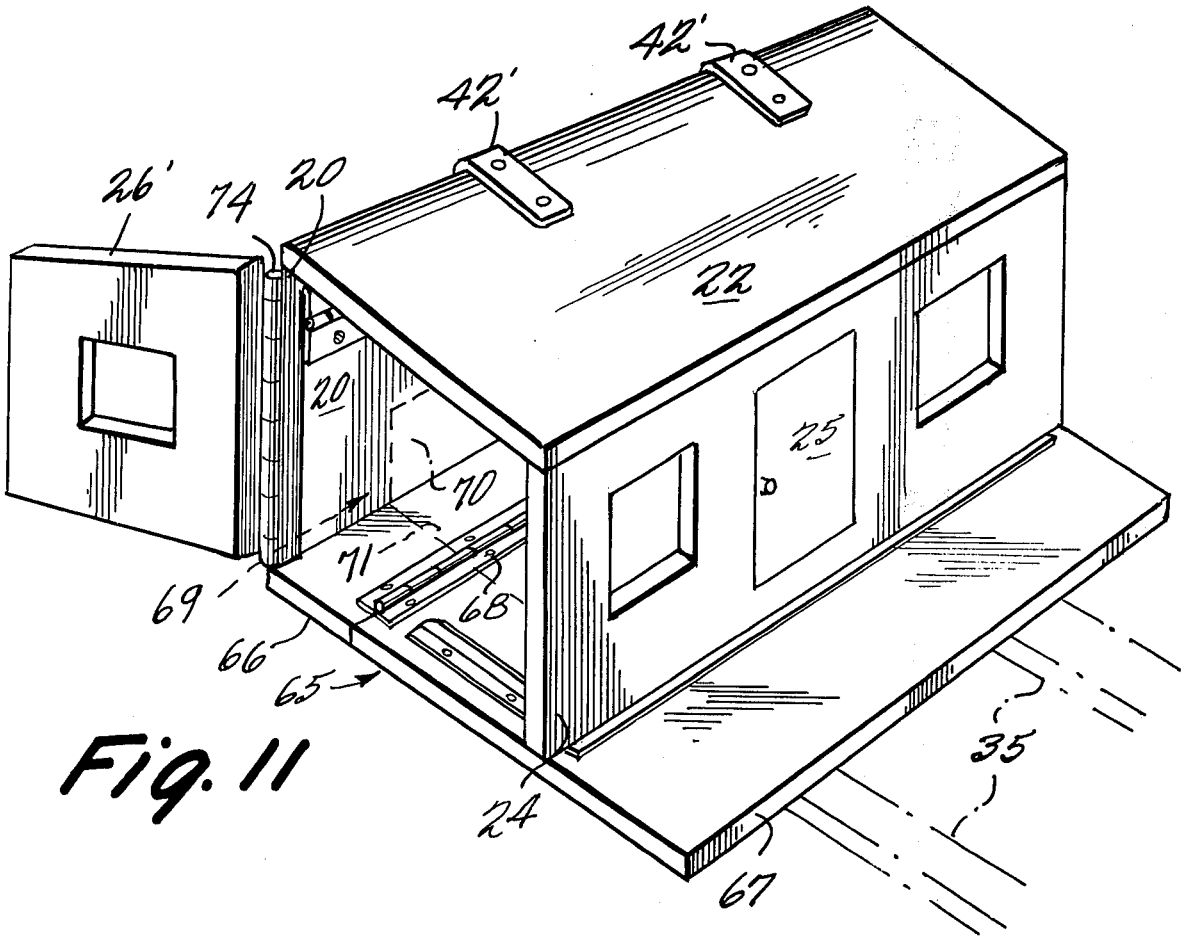
FIG. 11 is a perspective view of a further embodiment of a structure according to the present invention, disposed in a volume-defining position with one of the side walls down pivoted outwardly for clarity.
Figure 12:
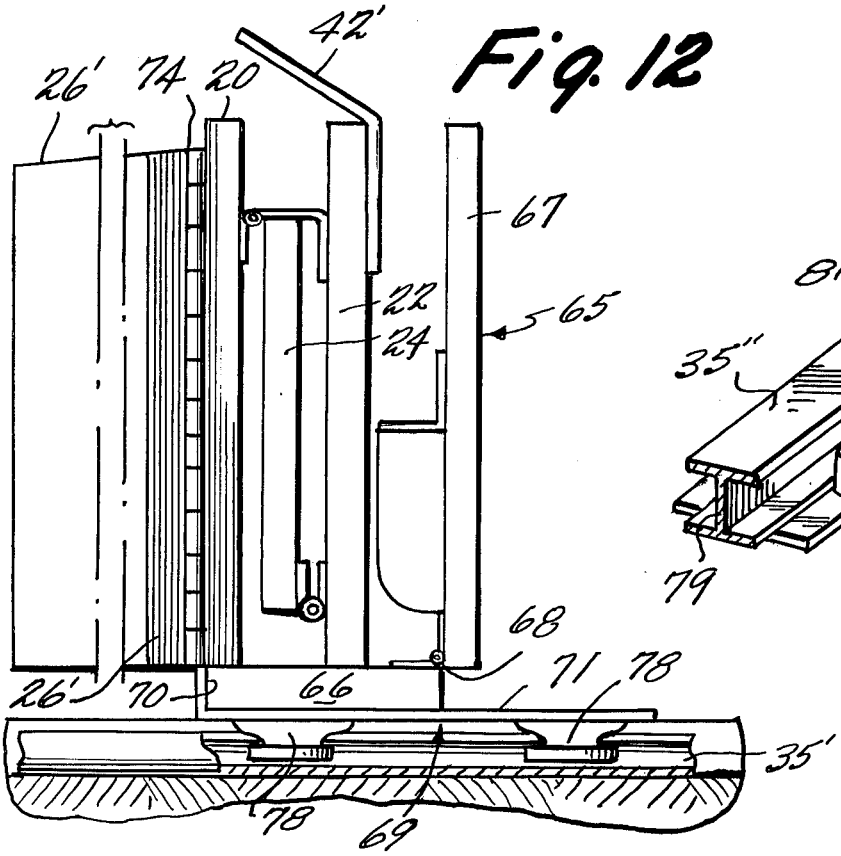
FIG. 12 is a side view of the structure of FIG. 11 when in a collapsed position, showing one of the side walls collapsed and the other pivoted outwardly for clarity.

Generally speaking, the embodiment of FIGS. 11 and 12 includes first (20), second (22), third (24) and fourth (65) structural members defining opposed walls, the roof, and the floor of a structure when in an assembled condition (FIG. 11), and defining a stack of four generally parallel members in a collapsed position (FIG. 12). The fourth member (65) has at least a portion thereof (67) mounted for pivotal movement with respect to said first member (20). The second member (22) is pivoted to both the first (20) and third (24) members. Fifth and sixth structural members (each 26') defining opposed walls generally perpendicular to the other of the structural members which define opposed walls in the assembled condition also may be provided, the fifth and sixth members (26') both pivotally mounted to said first member (20). Preferably, the first member comprises the rear wall 20, the second member the roof 22, the third member the front wall 24, the fourth member the floor 65, and the fifth and sixth members the side walls 26', and in the ensuing description the members will be described with such an orientation, although the first member could also define the floor, and other modifications are also possible.

The embodiment of FIGS. 11 and 12 (reference numerals corresponding to like numerals in the other Figures) includes a floor 65, the floor having at least a portion thereof mounted for pivotal movement with respect to the rear wall 20 so that in one position thereof the at least a portion of the floor 65 extends generally perpendicularly to the rear wall (FIG. 11), while in another position thereof it extends generally parallel to the rear wall (FIG. 12). For the embodiment shown in the drawings, the floor 65 includes a first portion 66 that is fixed with respect to the rear wall 20, extending generally perpendicularly to the rear wall 20 from a base portion thereof, and a second portion 67 pivotally mounted by a conventional hinge-type pivot 68 or the like to the first portion 66, for movement from the FIG. 11 to the FIG. 12 position. A bracket member 69 may be provided (shown in dotted line in FIG. 11) for mounting the first floor portion 66 to the rear wall 20, the bracket 69 having first and second portions 70, 71 thereof respectively disposed at a substantially right-angle with respect to each other, the first portion 70 fastened to the rear wall 20, and the second portion 71 fastened to the floor first portion 66. The bracket member 69 may extend across the whole width of the members 20, 66, or only part way across the width thereof.

The bracket 69 portion 71 can extend past the floor first portion 66 in a direction away from the wall 20 so that it is disposed under and supports the floor second portion 67 when the portion 67 is disposed in the position shown in FIG. 12. The first floor portion 66 may have a length (between the rear wall 20 and the pivot 68) at least as great as the thickness of the roof 22 and the front wall 24, so that when the rear wall 20, front wall 24, roof 22, and side walls 26 (26') are disposed in a horizontal stack (FIG. 12) the roof 22 and front wall 24 are disposed between the rear wall 20 and the second floor portion 67.

Especially where the structure is to be constructed of materials having a substantial thickness (such as wood, or foam with a frame), the side doors 26'—FIGS. 11 and 12—may be pivoted to the rear wall 20 by conventional pivoting means 74, so that they swing outwardly with respect to the wall 24, whereby the rear wall 20 is disposed between the side wall 26' and the roof 22 when the structure is in collapsed position (FIG. 12).

The floor section portion 67 may have disposed on the upper surface thereof an upstanding elongated flange assembly 76, extending generally parallel to and adjacent the front wall 24 and/or the side wall(s) 26' when the structure is in an expanded volume-enclosing position (FIG. 11). The flange assembly 76 may be provided generally for two purposes—to provide a form of weatherstripping (the assembly 76 may be constructed from flexible metal), and to provide an abutment against which the front wall 24 and/or side walls 26' may rest, and to which such walls may be clamped or locked if desired.

The means 42' may be provided for facilitating movement of the roof 22 from the position of FIG. 12 to that of FIG. 11, as by operatively connecting a counterweight, spring-loaded rod, cylinder, or the like, thereto (see FIG. 5 for example).

As shown in FIG. 12, the means for supporting the rear wall 20 in free-standing position may comprise rail means 35' or the like for allowing relative movement between the rear wall 20 and the ground. The rail means 35' particularly illustrated in FIG. 12 include a pair of rail means (only one being shown in FIG. 12—however, see the dotted line structures 35' in FIG. 11), each extending generally perpendicularly to the rear wall 20, and two pairs of rail-engaging supports 78 (only one pair shown in FIG. 11), the supports 78 extending connecting the bracket portion 71 to the rail means 35' so that the structure is moveable with respect to the ground along the rail means 35'. The rail means 35' may be buried in the ground, as shown in FIG. 12.

Figure 13:
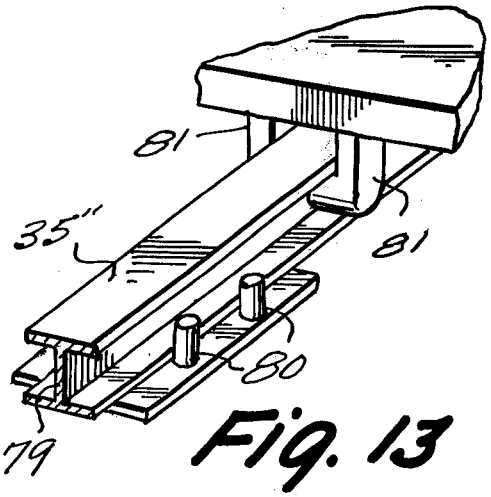
FIG. 13 is a perspective view of a further trail modification that may be utilized when the structure is to be mounted for movement with respect to the ground.

A further embodiment of exemplary rail means 35'' is shown in FIG. 13 (only one rail shown in FIG. 13), wherein an I-beam 79 or the like is supported on the ground by supports 80, and wherein members 81 are provided connected to the bracket portion 71 (or like portion of the structure) to allow riding movement of the structure with respect to the beams 79.

Figure 6:
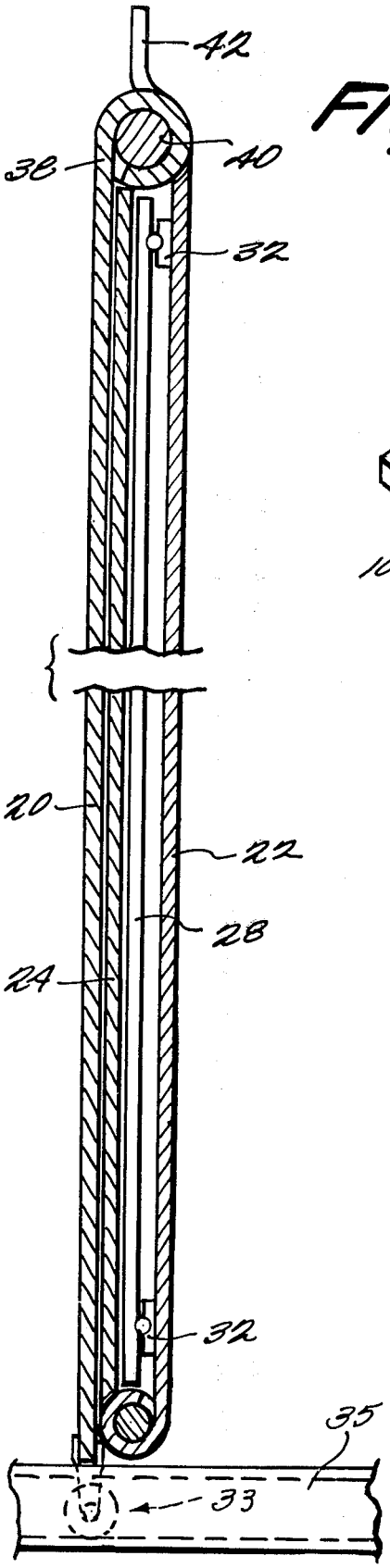
FIG. 6 shows a vertical sectional view through the structure of FIG. 1.

Some sort of locking mechanism may be provided for locking the component parts of the structure together in the collapsed position (FIGS. 6 and 12), such as flange members extending from wall 20 to roof 22 or floor portion 67, the flange members padlocked together; and/or a container may be provided enclosing the entire structure in the collapsed position, or enclosing the container on several dimensions, and the rear wall 20 or like part forming a wall of the container. When rail means are used, electrical wires and the like may be run through the rail means into the structure, and when rail means are not employed, the electrical wires may merely be run in through the floor of the structure (as through floor portion 66).

In order to provide more privacy within the interior of the structure, or for other reasons as desired, partition means 85 may be provided mounted to the floor, walls, or roof of the structure. Preferably, as indicated in FIG. 14, the partition means 85 are mounted to the floor portion 67, the means 85 comprising a first partition member 86 which is mounted by pivot 87 to the floor portion 67, and a second partition member 88 which is mounted by pivot 89 to the first partition member 86 for pivotal movement about an axis generally perpendicular to the axis about which the member 86 is pivoted. An opening 90 may be provided in the member 86 large enough to allow the passage of an adult human being therethrough, and the top of the partition members 86, 88, will be preferably contoured to correspond to the contour of the roof of the structure. To fold up the partition means 85, it is merely necessary to pivot the member 88 into face-to-face engagement with the member 86, and then pivot the member 86 about the pivot 87 until it is in face-to-face engagement with the floor 67. The entire structure may then be moved to its collapsed position (e.g., FIG. 12).

The structure can be secured to the ground, if desired, by a connecting member 91 extending through the floor 67 and operatively engaging the ground, or an accessory structure mounted in the ground.

Under some circumstances, it is desired to have a larger living area than can be provided by a single structure. In such circumstances, connecting arrangements such as shown in FIGS. 15 through 18 may be provided. An opening 92 is provided in a wall (e.g., the rear wall 20) of the structures to be connected together, the opening 92 being large enough to allow the passage of an adult human being therethrough. The structures are then connected together at the opening utilizing a flange member or tunnel-forming members. A flange member 93 that may be utilized is illustrated in FIGS. 15 and 16, the member 93 having lip members 94, 94', extending perpendicularly from either side thereof, each of the lip member 94, 94', having a contour such that the lip members tightly engage the area surrounding a respective opening 92 in a structure, thereby mounting two structures together. The manner in which the flange member 93 interfits with an opening 92 is indicated generally in FIG. 16.

Figure 18:
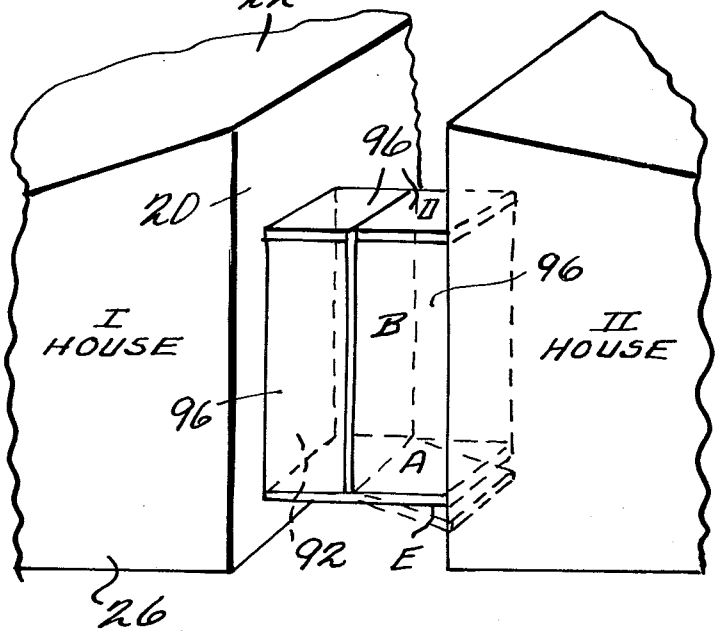
FIG. 18 is a perspective view of two structures connected together utilizing connecting means such as shown in FIG. 17.

Tunnel-forming members 96 are illustrated in FIGS. 17 and 18, which members 96 are another connecting means embodiment. The members 96 are pivoted, as by pivots 97, adjacent an opening 92. Preferably, four tunnel-forming members 96 are associated with each structure, the members having cooperating surface portions 98, 98', thereof which engage each other when the members 96 are pivoted away from the wall to which they are connected, the members 96 cooperating with like members 96 from a second structure to form a tunnel-connecting structure, as shown in FIG. 18.

Figure 19:
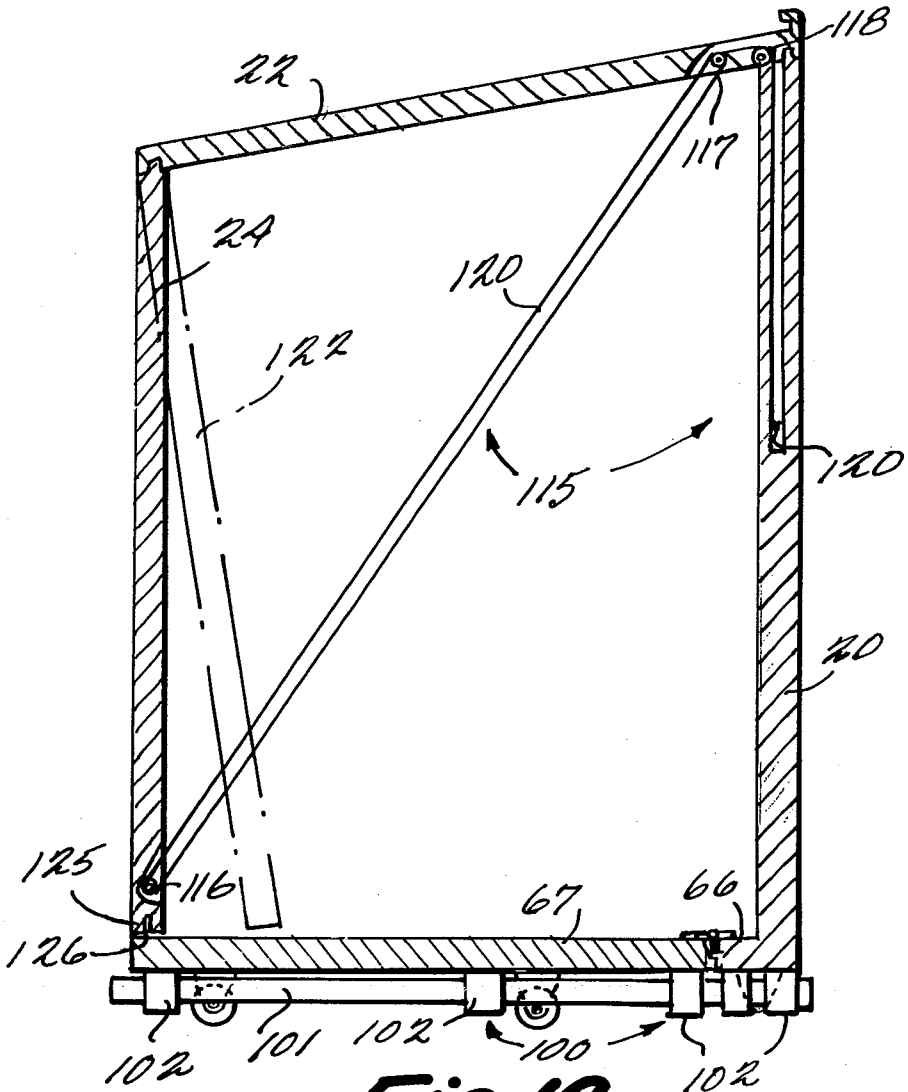
FIG. 19 is a side view, partly in section and partly in elevation, of a structure according to the present invention in assembled condition.
Figure 21:
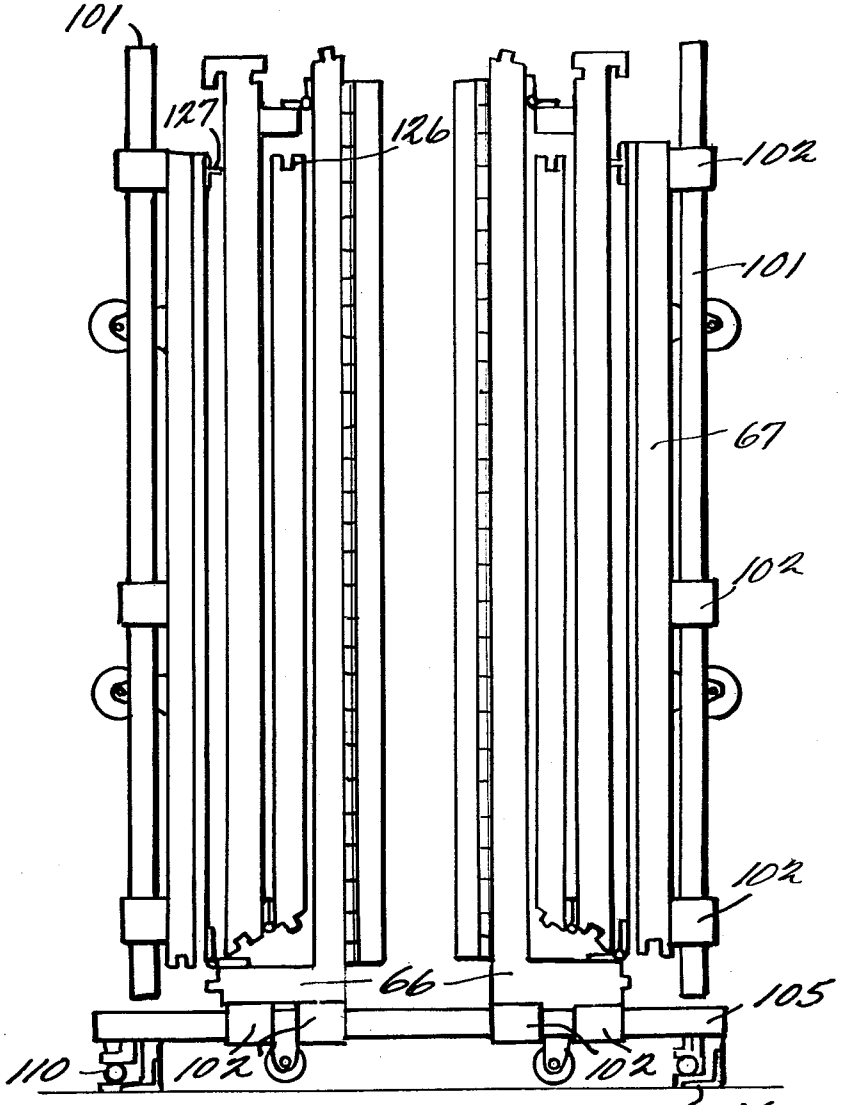
FIG. 21 is a side view like that of FIG. 20 only showing two like structures in collapsed position.
Figure 20:
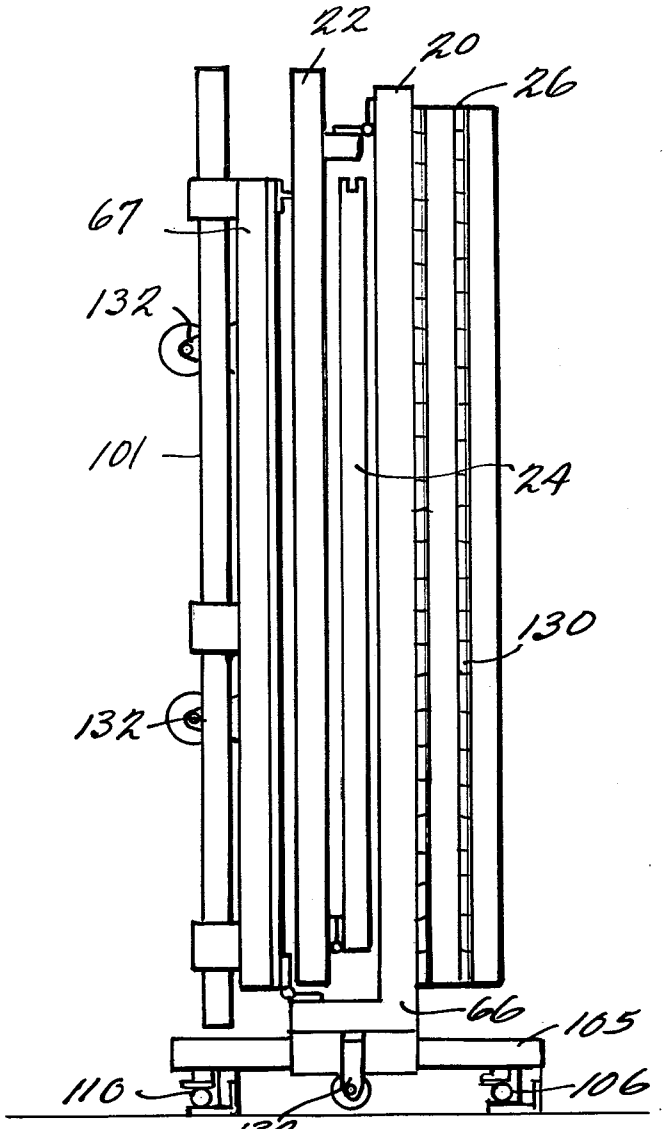
FIG. 20 is a side view of a structure according to the present invention in collapsed position for ease of transport.
Figure 22:
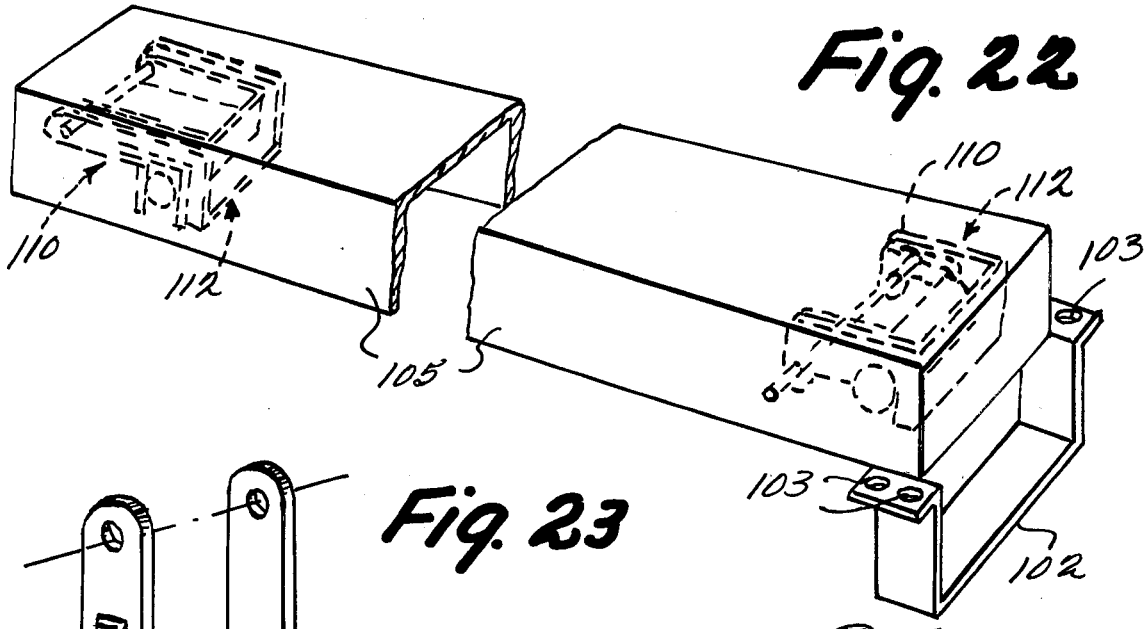
FIG. 22 is a schematic view of an exemplary channel and channel guide utilizable in the structure of FIGS. 20 and 21.
Figure 23:
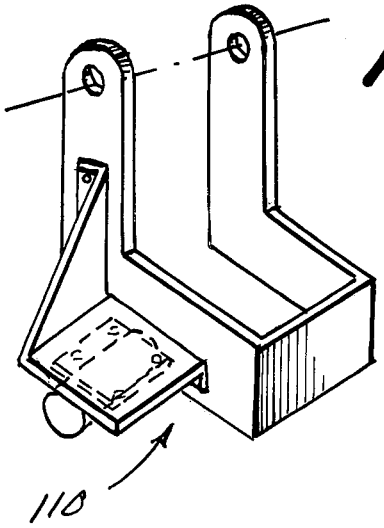
FIGS. 23 through 26 are perspective views of various components mounted in association with the channel of FIG. 22.
Figure 24:
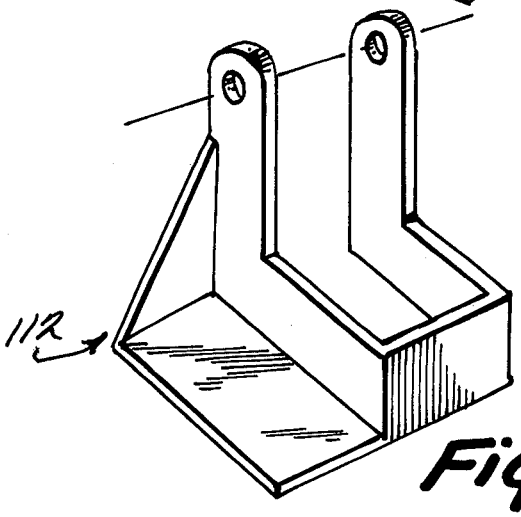
Figure 25:
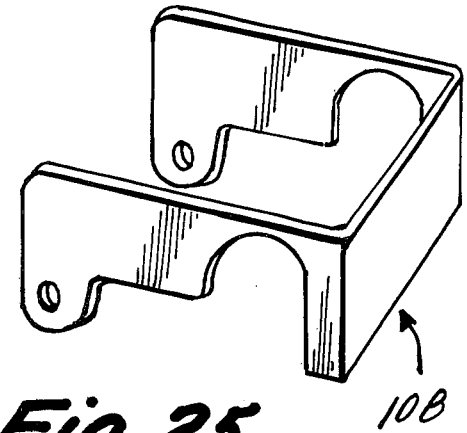
Figure 26:
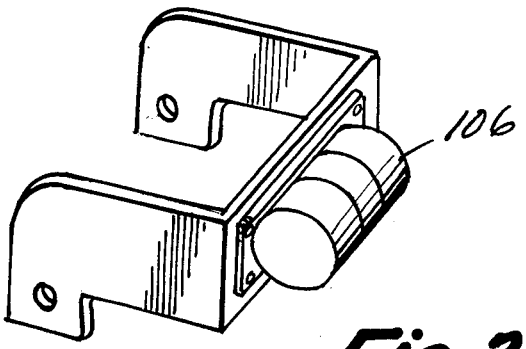

In order to brace the floor in the assembled position, locking the first and second floor portion 66, 67, together, means 100 are formed on the bottom of the floor 65 for receipt of an elongated straight bracing member (floor beam) 101, as illustrated in FIGS. 19 through 21. The means 100 comprise a plurality of channel guides, which are U-shaped members (see FIG. 22) connected at the upper ends 103 thereof to the bottom of the floor 65. Means may also be provided which utilizes the channel guides 102 for facilitating transport of the structure when in a collapsed position, such transport facilitating means comprising a channel 105 or the like having wheels (or casters) 106 associated therewith. Means are provided for mounting the wheels 106 or the like so that they are pivotal from a position wherein they are completely contained within the U-shaped channel 105, to a position—as illustrated in FIGS. 20 and 21—wherein they extend outwardly through the open portion of the U-shaped channel 105 into engagement with the ground. Also, a brake plate 108 may be associated with the wheels 106. A wheel set 110 may also be provided which is pivotally mounted for movement with respect to the channel 105, and brake plate 112 pivotally mounted for association with the wheel set 110, the brake plate 112 being pivotal to go underneath the wheel set 110 to hold it in a stationary position, just as the brake arrangement 108 is provided for holding the wheel set 106 in stationary position. The channel 105 may be dimensioned to support a single structure thereon, as indicated in FIG. 20, or to support two folded-up structures thereon in back-to-back relationship, as indicated in FIG. 21.

In order to elevate the structure roof 22 and front wall 24 into place, a pulley system such as shown generally at 115 in FIG. 19 may be provided. The pulley system includes a plurality of pulleys 116, 117, 118 mounted to interior portions of the front wall 24 and roof 22 respectively, with a cord 120 that is strung around the pulleys extending out the rear wall 20. In order to elevate the structure, one pulls down on the free end of the cord 120, lifting the roof 22 into a first position, and then uses a brace—shown at dotted line at 122—or the like to initially support the roof 22 in place until the front wall 24 is pivoted into place. The front wall 24 has a bottom edge 125 with a groove 126 formed therein, the groove for receipt of an upstanding elongated flange 127 (such as a T-shaped flange) attached to the bottom portion 67 and adjacent to the front wall 24 when the structure is in its assembled position.

As another modification of the structure according to the present invention, the side doors 26, 26', thereof may be double hinged (i.e., hinged at the middle thereof) as indicated at 130 in FIG. 20 for the side door 26.

Figure 27:
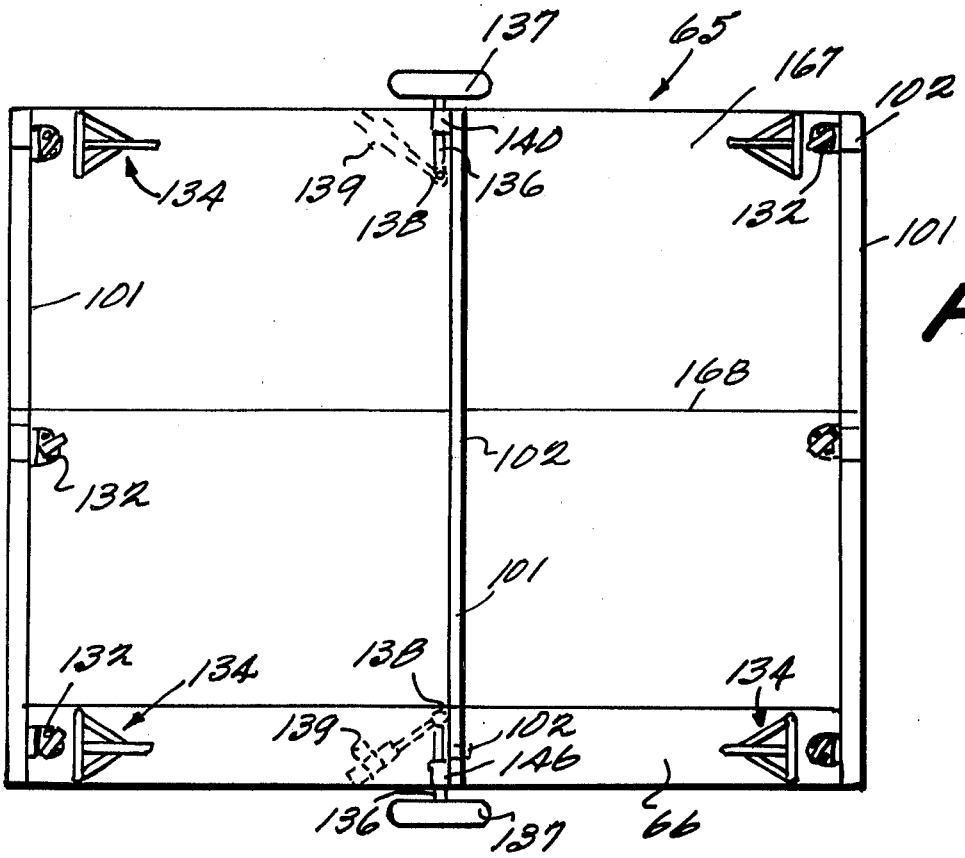
Figure 28:
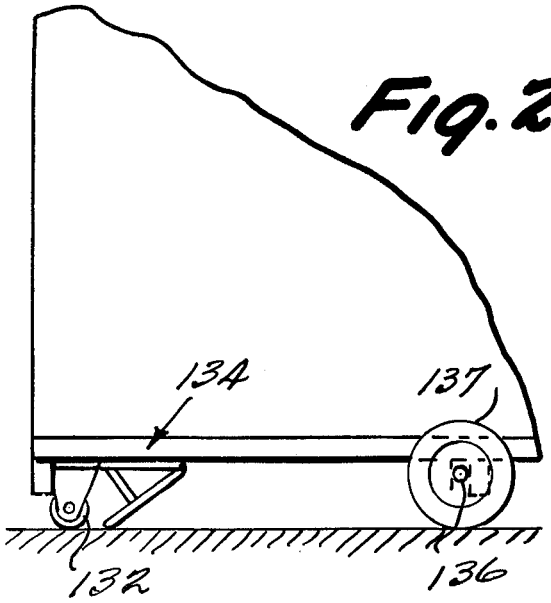
Figure 29:
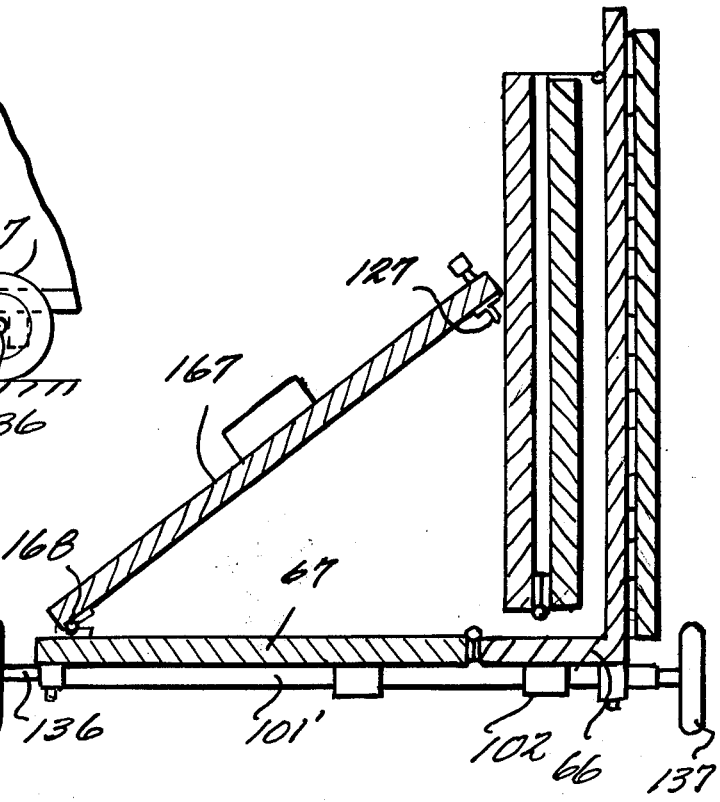

In order to permit limited movement of the structure when it is in assembled condition, casters 132 may be provided mounted on the floor 65. These casters may have screw-threaded shafts or the like which allow adjustment of the effective length thereof so that the structure may be leveled once in place even if on uneven terrain. Additionally, conventional jacks 134 or the like may be provided mounted on the bottom of the floor 65 (see FIGS. 27 and 28 in particular) which jacks 134 can level the structure and hold the structure in the ultimate position to which it is placed and/or elevate the structure to facilitate the placement of wheels on the structure that will allow highway transport of the structure when in assembled or collapsed (or partially collapsed) position, and allow towing of the structure behind a vehicle. The means that allow mounting of the structure for movement along highways or the like comprises at least a pair of axles 136 mounted to opposite sides of the floor 65, one axle 136 being mounted to the first floor portion 66, and the other axle being mounted to the second floor portion 67, as indicated in FIG. 29. Detachable wheels 137 are mounted for placement on the axles 136 in operative association therewith, and preferably the axles 136 are mounted by a universal joint—shown schematically at 138 in FIG. 27—which allows pivotal movement of the axle 136 about a vertical axis (to the dotted line position indicated in FIG. 27) so that it can be moved from an operative position to an inoperative position, in which inoperative position it is held in place by a clamp 139, and being held in the operative position by a clamp 140 or the like. Of course the axle 136 can rotate in addition to being pivotally moveable about the universal joint 138. Under some circumstances, it is desirable to transport the structure in a collapsed position (which minimizes air resistance among other things), however, it is still important to have a fairly wide base so that the structure will not tip over—wider than is provided merely by the first floor portion 66. In such situations, the floor 65 preferably is constructed so that it has a third floor portion 167 (see FIGS. 27 and 29) which is pivoted about pivot 168 to the second floor portion 67, and is moveable to the position indicated in FIG. 29.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A convertible structure comprising:

a free-standing rear wall having top and bottom edges extending generally linearly and defining a generally vertical plane;

means operatively connecting said free-standing rear wall to the ground for supporting the rear wall in free-standing position;

a roof having opposed front and rear edges extending generally parallel to said rear wall top and bottom edges, said roof being pivotally connected at its rear edge to an upper portion of said rear wall;

a front wall pivotally connected to said roof generally along the front edge of said roof; and side walls pivotally mounted to said rear wall, so that said side walls, front wall and roof can be pivoted and folded together into a vertically extending stack so that all of said side walls, front wall, and roof extend generally parallel to said rear wall, and so that said rear wall is disposed between said side walls and said roof when said vertical stack is formed.

2. A convertible structure comprising first, second, third, and fourth structural members, said members defining opposed walls, the roof, and the floor of a structure when in an assembled condition, and defining a stack of four generally parallel members in collapsed position, said first member pivotally connected to said second member along the edge of said second member, and said second member pivotally mounted to said third member along an opposite edge of said second member, said fourth member having at least a portion thereof mounted for pivotal movement with respect to said first member so that in said assembled position thereof at least a portion of said fourth member extends generally perpendicularly to said first member, and in the collapsed position thereof extends generally parallel to said first member, and fifth and sixth structural members defining opposite walls generally perpendicularly to those structural members, of the first, second, third and fourth structural members which define said opposed walls in said assembled condition, said fifth and sixth structural members both pivotally mounted to said first member and in said collapsed position said stack comprising parallel members comprising in order said fifth and sixth members; said first member; said third member; said second member; and said at least a portion of said fourth member.

3. A convertible structure comprising first, second, third, and fourth structural members, said members defining opposed walls, the roof, and the floor of a structure when in an assembled condition, and defining a stack of four generally parallel members in a collapsed position, said first member pivotally connected to said second member, and said second member pivotally mounted to said third member along an opposite edge of said second member;

said fourth member having at least a portion thereof mounted for pivotal movement with respect to said first member so that in said assembled position thereof said at least a portion of said fourth member extends generally perpendicular to said first member, and in the collapsed position thereof extends generally parallel to said first member; and partition means pivotally connected to one of said members for partitioning said structure when in said assembled position, and in said collapsed position extending generally parallel to said first member; said partition means comprising a first partition member pivoted to one of said members for pivotal movement with respect thereto from a position parallel to said member to a position perpendicular to said member, and a second partition member pivoted to said first partition member for pivotal movement about an axis generally perpendicular to the axis about which said first partition is pivoted.

4. A structure as recited in claim 3 wherein at least one of said partition members had a door opening formed therein.

5. A structure as recited in claim 3 wherein said fourth member comprises the floor and wherein said first partition member is pivoted to said floor.

6. A convertible structure comprising first, second, third, and fourth structural members, said members defining opposed walls, the roof, and the floor of a structure when in an assembled condition, said defining a stack of four generally parallel members in a collapsed position, said first member pivotally connected to said second member along one edge of said second member, and said second member pivotally mounted to said third member along an opposite edge of said second member;

said fourth member comprising the structure floor and said first member comprising a vertically upstanding rear wall, said floor including a first portion, and a second portion pivotally mounted to said first portion for movement from said assembled position to said collapsed position;

means formed on the bottom of said fourth member for receipt of an elongated supporting component for bracing said floor and for locking said first and second floor portions in said assembled position, comprising a plurality of channel guides, arranged in a straight line so that all guides in a set may receive a straight bracing member therein, at least one of said channel guides being formed on said first floor portion; and transport means for facilitating transport of said structure when in collapsed position, said facilitating transport means including a channel having wheels associated therewith, said channel being dimensioned to be received by said at least a channel guide formed on said first floor portion.

7. A structure as recited in claim 6 wherein said channel comprises a generally U-shaped channel having at least one bottom opening, and further comprising means for mounting said wheels associated with said channel for pivotal movement from a position wherein they are completely contained within said channel to a position wherein they extend outwardly from said channel through said at least one channel bottom opening.

8. A structure as recited in claim 7 further comprising brake plate means pivotally mounted to said channel for pivotal movement into and out of said channel for selectively not braking and braking said wheels.

9. A structure as recited in claim 6 wherein said channel is dimensioned to mount said structure and a like said structure in the collapsed position, back-to-back, supporting both for transport.

10. A convertible structure comprising first, second, third, and fourth structural members, said member defining opposed walls, the roof, and the floor of a structure when in an assembled condition, and defining a stack of four generally parallel members in a collapsed position, said first member pivotally connected to said second member along one edge of said second member, and said second member pivotally mounted to said third member along an opposite edge of said second member;

said fourth member comprising the structure floor and said first member comprising a vertically upstanding rear wall, said floor including a first portion that is fixed with respect to said rear wall, and a second portion pivotally mounted to said first portion for movement from said assembled position to said collapsed position;

means formed on the bottom of said fourth member for receipt of an elongated supporting component for bracing said floor and for locking said first and second floor portions in said assembled position; and means for mounting said structure when in assembled or collapsed position for movement along highways or the like, said means comprising at least a pair of axles mounted to opposite sides of said floor, one axle being mounted to said first floor portion and the other axle being mounted to said second floor portion, and a pair of detachable wheels for mounting on said axles.

11. A structure as recited in claim 10 wherein said axles are mounted for pivotal movement about a vertical axis so that they are movable from an inoperative to an operative position, as well as being mounted for rotation.

12. A structure as recited in claim 10 wherein said floor comprising a third floor portion pivotally mounted to said second floor portion, and further comprising an axle associated with said third floor portion.

13. A convertible structure comprising first, second, third, and fourth structural members, said members defining opposed walls, the roof, and the floor of a structure when in an assembled condition, and defining a stack of four generally parallel members in a collapsed position, said first member pivotally connected to said second member along one edge of said second member, and said second member pivotally mounted to said third member along an opposite edge of said second member;

said fourth member having at least a portion thereof mounted for pivotal movement with respect to said first member so that in said assembled position thereof said at least a portion of said fourth member extends generally perpendicular to said first member, and in the collapsed position thereof extends generally parallel to said first member;

said fourth member comprising the floor and said first member comprising a vertically upstanding rear wall;

said floor including a first portion that is fixed with respect to said rear wall, and a second portion pivotally mounted to said first portion for movement from said assembled position to said collapsed position;

a bracket member having first and second portions disposed at a substantially right angle with respect to each other, said first portion fastened to said rear wall, and said second portion fastened to said floor first position, said bracket second portion extending past said floor first portion so that it is disposed under and supports said floor second portion when said floor second portion extends generally perpendicularly to said rear wall; and means for supporting said rear wall in free-standing position, comprising rail means, extending generally perpendicularly to said rear wall, and rail-engaging supports extending vertically from said bracket member and operatively connecting said bracket member to said rail means to that said structure may be moved with respect to the ground along said rail means.

* * * * *